US009332822B2

(12) United States Patent
Hunt

(10) Patent No.: US 9,332,822 B2
(45) Date of Patent: May 10, 2016

(54) EQUIPMENT CARRIER WITH A TENSIONED TETHER THAT RETAINS EQUIPMENT IN AN EQUIPMENT HOLDER

(71) Applicant: FL Archery Holdings LLC, Superior, WI (US)

(72) Inventor: Fred H. Hunt, Duluth, MN (US)

(73) Assignee: FL Archery Holdings LLC, Superior, WI (US)

( * ) Notice: Subject to any disclaimer, the term of this patent is extended or adjusted under 35 U.S.C. 154(b) by 0 days.

(21) Appl. No.: 14/107,037

(22) Filed: Dec. 16, 2013

(65) Prior Publication Data

US 2014/0367438 A1 Dec. 18, 2014

Related U.S. Application Data

(63) Continuation-in-part of application No. 13/180,549, filed on Jul. 12, 2011.

(51) Int. Cl.

| | |
|---|---|
| ***A45F 3/04*** | (2006.01) |
| ***A45F 5/00*** | (2006.01) |
| ***A45F 5/14*** | (2006.01) |

(52) U.S. Cl.

CPC . *A45F 3/047* (2013.01); *A45F 5/00* (2013.01); *A45F 5/14* (2013.01); *A45F 2005/008* (2013.01); *A45F 2200/0533* (2013.01)

(58) Field of Classification Search

CPC A45C 11/08; A45C 11/38; A45F 2200/0533; A45F 2003/045

USPC ..... 224/162, 242, 262, 254, 908, 909, 268, 224/458, 651; 248/693, 610; 396/420, 423, 396/425

See application file for complete search history.

(56) References Cited

U.S. PATENT DOCUMENTS

| | | | | |
|---|---|---|---|---|
| 2,643,803 | A * | 6/1953 | Bates | 224/254 |
| 3,307,757 | A | 3/1967 | Gatos et al. | |
| 3,547,323 | A | 12/1970 | Sledge, Jr. | |
| 3,782,614 | A | 1/1974 | Campisi | |
| 4,328,917 | A * | 5/1982 | Reeberg | 224/254 |
| 5,016,797 | A | 5/1991 | Rowledge | |
| 5,172,838 | A | 12/1992 | Rowell et al. | |
| 5,323,942 | A | 6/1994 | Dahan | |
| 5,524,749 | A | 6/1996 | Thompson et al. | |
| 5,632,428 | A * | 5/1997 | Weiss | 224/623 |
| 6,471,054 | B2 | 10/2002 | Nevarez | |
| 6,926,184 | B2 | 8/2005 | Hancock et al. | |
| 7,059,503 | B2 | 6/2006 | Andersen | |
| 2003/0029895 | A1 * | 2/2003 | Andersen | A45F 3/14 224/579 |
| 2004/0140335 | A1 * | 7/2004 | Hancock | A45F 3/14 224/637 |
| 2004/0206792 | A1 * | 10/2004 | Mineer | 224/259 |
| 2006/0151563 | A1 | 7/2006 | Bussard | |
| 2007/0152007 | A1 | 7/2007 | Kauss et al. | |
| 2010/0052931 | A1 | 3/2010 | Kolpasky et al. | |

* cited by examiner

*Primary Examiner* — Adam Waggenspack

(74) *Attorney, Agent, or Firm* — Covington & Burling LLP; Gregory S. Discher; Grant D. Johnson

(57) ABSTRACT

An equipment carrier configured to secure at least one piece of equipment to a user, and corresponding method. The equipment carrier includes at least one equipment holder configured to be secured to the user. The equipment holder includes an engaging portion configured to receive the equipment. At least one tether includes a first portion attached to the equipment and a second portion attached to the user at a second location offset from the engaging portion. The at least one tether applies a tension force on the equipment to retain the equipment with the engaging portion of the equipment holder. The tension force is negligible when the equipment is disengaged from the equipment holder and positioned near the second location.

10 Claims, 16 Drawing Sheets

EQUIPMENT CARRIER WITH A TENSIONED TETHER THAT RETAINS EQUIPMENT IN AN EQUIPMENT HOLDER

RELATED APPLICATIONS

The present application is a Continuation-in-Part of U.S. patent Ser. No. 13/180,549, entitled Equipment Carrier with Extensible Tether, filed Jul. 12, 2011, the entire disclosure of which is hereby incorporated by reference.

FIELD OF THE INVENTION

The present disclosure is directed to an equipment carrier that retains equipment, such as binoculars, cameras, range finders, GPS systems, and other equipment, to a user, and to a locking mechanism for securing the equipment to the equipment holder.

BACKGROUND OF THE INVENTION

A wide variety of carriers exist for binoculars, cameras, range finders, GPS systems, and other similar equipment. Various carriers that secure the device to the user tend to limit access to the device and typically require two hands to operate. For example, a neck strap is not sufficient to secure binoculars when the user is engaged in kinetic activity. A more elaborate structure is required, which in turn, reduces access to the equipment.

Gaining quick and easy access to a device, especially with only one hand, has proven to be difficult to achieve with existing carriers.

BRIEF SUMMARY OF THE DISCLOSURE

The present disclosure is directed to an equipment carrier configured to secure at least one piece of equipment to a user. The equipment carrier includes at least one equipment holder configured to be secured to the user. The equipment holder includes an engaging portion configured to receive the equipment. At least one tether includes a first portion attached to the equipment and a second portion attached to the user at a second location offset from the engaging portion. The at least one tether applies a tension force on the equipment to retain the equipment with the engaging portion of the equipment holder. The tension force is negligible when the equipment is disengaged from the equipment holder and positioned near the second location.

The engaging portion optionally includes a locking assembly configured to lock a base plate attached to the equipment to the equipment holder. The base plate is releasably attached to the equipment, such as a shoe for a camera. The base plate is configured to attach the equipment to other structures, such as a tripod. The locking assembly is typically biases to a locked configuration and the base plate slides into engagement with the locking assembly.

The tether can be an elastically deformable member or a retraction mechanism that generates the tension force. The equipment holder can be attached to one of the user, or a backpack, a safety or utility vest, a utility belt, a harness, a hydration pack, or other garments or equipment worn by the user. The second portion of the tether can be attached to one of the user, or a backpack, a safety or utility vest, a utility belt, a harness, a hydration pack, or other garments or equipment worn by the user.

The present disclosure is also directed to a method of securing at least one piece of equipment to a user. The method includes attaching an equipment holder to the user. A first portion of a tether is attached to the equipment and a second portion is attached to the user at a location offset from an engaging portion of the equipment holder. The equipment is positioned against the engaging portion of the equipment holder in opposition to a tension force applied by the tether. The tension force sufficient to retain the equipment with the engaging portion of the equipment holder. When the equipment is removed from the equipment holder the tension force is negligible when the equipment is positioned near the second location.

Figure 1:
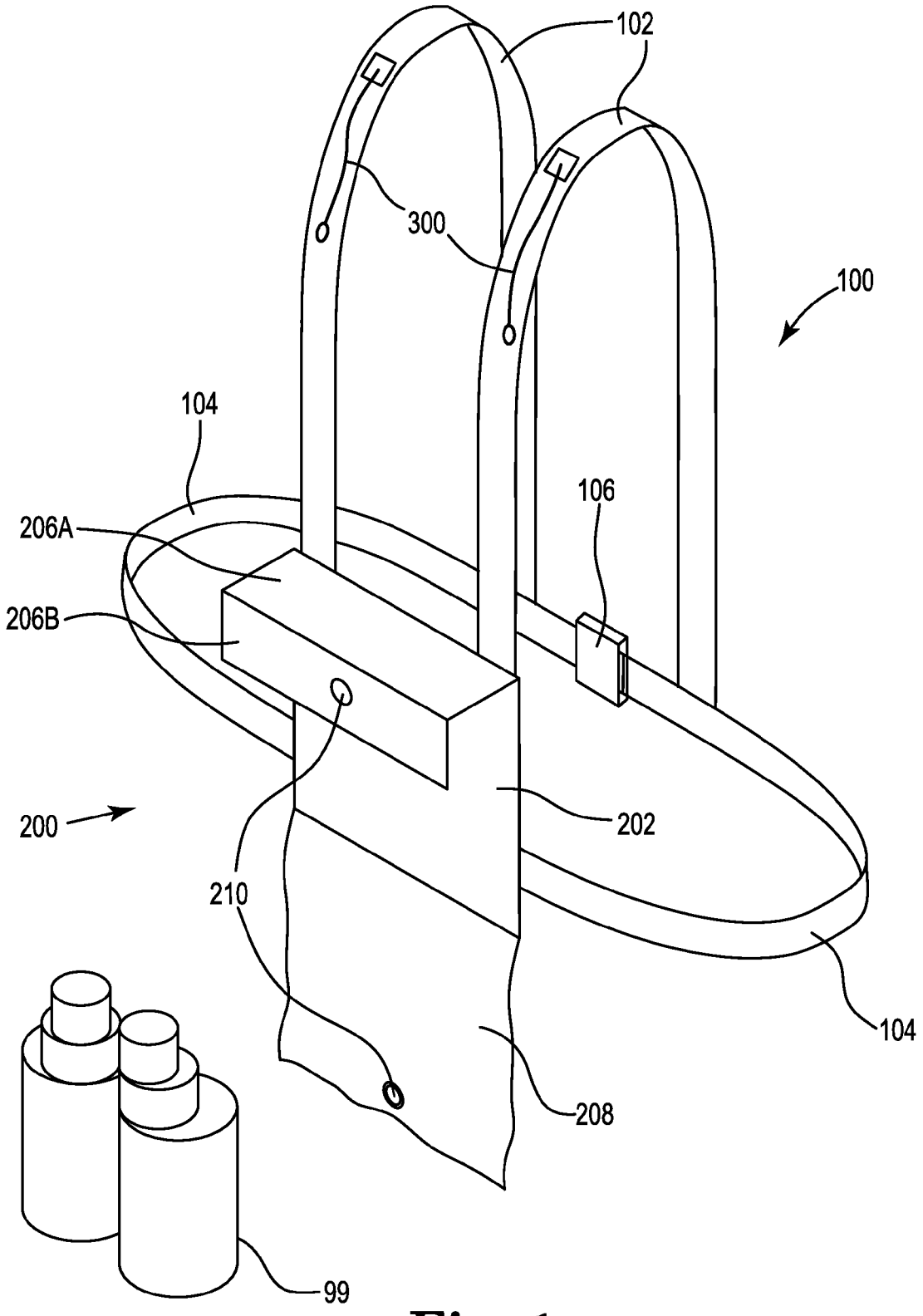
FIG. 1 is a perspective view of an equipment carrier in accordance with an embodiment of the present disclosure.

It should be noted that the embodiments depicted in this disclosure are shown only schematically, and that not all features may be shown in full detail or in proper proportion. Certain features or structures may be exaggerated relative to others for clarity. It should be noted further that the embodiments shown are exemplary only, and should not be construed as limiting the scope of the written description or appended claims.

DETAILED DESCRIPTION OF EMBODIMENTS

FIGS. 1-5 illustrate one embodiment of an equipment carrier 100 in accordance with an embodiment of the present disclosure. In the illustrated embodiment, the equipment carrier 100 includes a pair of shoulder straps 102, a waist strap 104, and a buckle 106 configured to secure to a user 50. The straps 102, 104 can be constructed from a variety of suitable materials such as nylon or canvas) and can be arranged with a variety of buckles, ties, closures, and the like.

Figure 5:
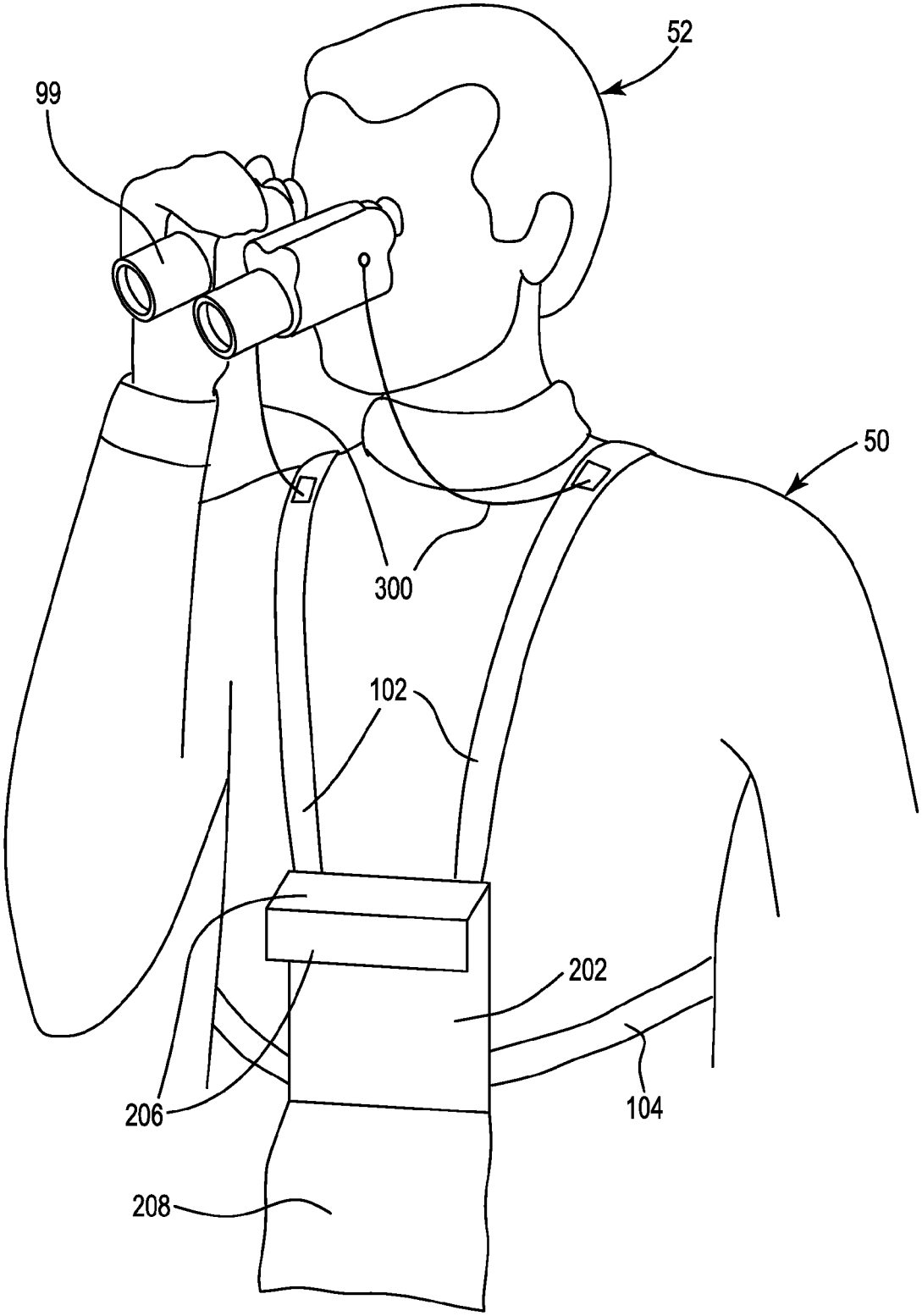
FIG. 5 is a perspective view of the equipment carrier of FIG. 4 with the user accessing the device in accordance with an embodiment of the present disclosure.

Equipment holder 200 is attached to one or more of the straps 102, 104 so as to be supported against a wearer's chest or belly, within easy reach (see e.g., FIG. 5). More generally, the equipment holder 200 can be held at any convenient or suitable position against the user's torso or limbs (see e.g., FIG. 9). The position of the equipment holder 200 (e.g., its height) can be fixed or adjustable on the equipment carrier 100, such as by adjustment of strap lengths or a sliding buckle attached to one of the straps 102, 104. In an alternate embodiment discussed herein, the equipment holder 200 can be attached to straps of another structure, such as a backpack, so the straps 102, 104 are not necessary.

In the illustrated embodiment, the equipment holder 200 includes back panel 202, top panel 206A, and front panel 206B ("the top front panels 206"), and can further include a flexible bottom front panel 208. The flexible bottom front panel 208 is attached to a lower portion of back panel 202 and can fold upward to be releasably attached to the top front panel 206. The equipment holder 200 can be sized to accommodate the equipment 99 between the various panels of the equipment holder 200 with the bottom front panel 208 folded upward and attached to top front panel 206. The bottom front panel 208 is attached to the top front panel 206 by any suitable fastener or closure mechanism 210 (e.g., snap, hook-and-loop, magnet, and so on). The equipment holder 200 can be configured to hold any equipment 99 desired to be kept within easy reach for the user, such as a pair of binoculars, a laser rangefinder, a camera, GPS system, cell phone, or some other device.

The back panel 202 and top front panels 206 preferably form a rigid or semi-rigid structure that nevertheless exhibits a small degree of elastic deformability. The back panel 202 and the top front panel 206 are preferably shaped to form a recess 205 sized to receive the equipment 99. The recess 205 can be arranged to provide an interference fit when the equipment 99 is inserted to help to retain it in the equipment holder 200.

In another embodiment, the top front panels 206 are plastically deformable (or pre-molded) to be shaped to the equipment 99. For example, the top front panel 206 can be a ductile metal structure that can be deformed to the shape of the equipment 99. Alternatively the top front panel 206 may be constructed from a thermoplastic material that can be heated a sufficient amount to permit shaping to conform to the equipment 99.

One or more tethers 300 are provided to attach the equipment 99 to the user 50. In one embodiment, the tethers 300 are constructed from an elastic material (e.g., shock or bungee cord, elastic polymer or other suitable elastic material) that provide bias force F when extended. The tethers 300 preferably have a desired rest length when under negligible tension, but that is under tension when lengthened. In another embodiment, the tethers are tensioned by retraction mechanisms, such as illustrated in FIG. 6B. The tension force F is preferably sufficient to retains the equipment 99 in the recess 205, even when the user is engaged in kinetic activities (i.e., running, climbing, jumping, etc.).

Figure 2:
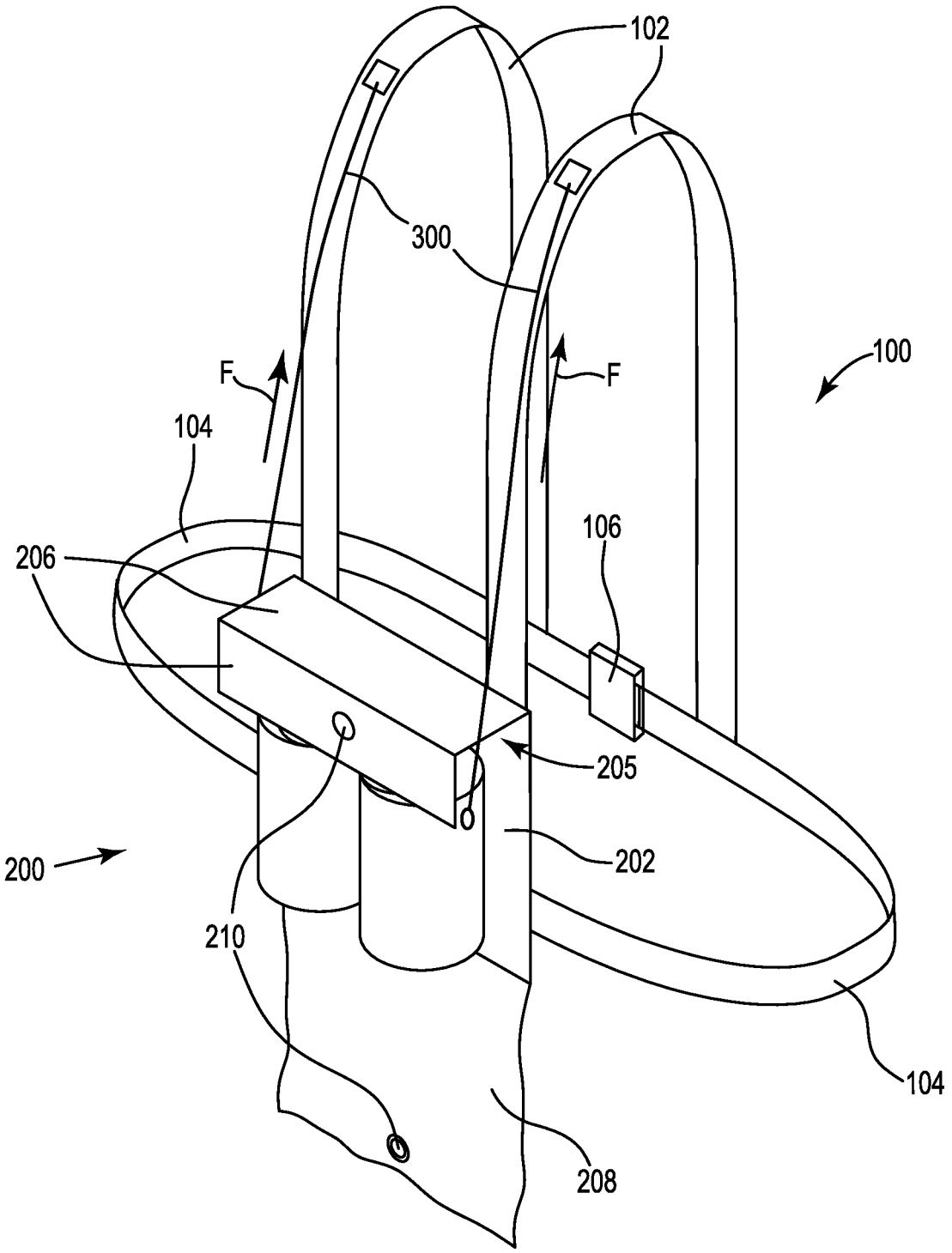
FIG. 2 is a perspective view of the equipment carrier of FIG. 1 with tethers biasing an item of equipment into engagement with the equipment holder in accordance with an embodiment of the present disclosure.

In the illustrated embodiment, two tethers 300 are attached to the shoulder straps 102 at one end and to the equipment 99 at the other end. As best illustrated in FIG. 2, the tethers 300 provide tension forces F that biases the equipment 99 in recess 205 in the top panels 206. Using two tethers 300 balances the forces F on the equipment 99 when positioned in the recess 205.

The tethers 300 can be attached in any suitable way to the equipment holder 200 or to the support members 102/104 (e.g., tied, stitched, stapled, tacked, riveted, glued, buckled, latched, clamped, secured by hook-and-loop, and so on). The tethers 300 can be arranged or adapted to be attached in any suitable way to the equipment 99 (e.g., tied around the item, looped through an eyelet or similar structure on the item, attached to a case or sleeve for the item, attached to a mounting plate secured to the item, and so on).

Figure 3:
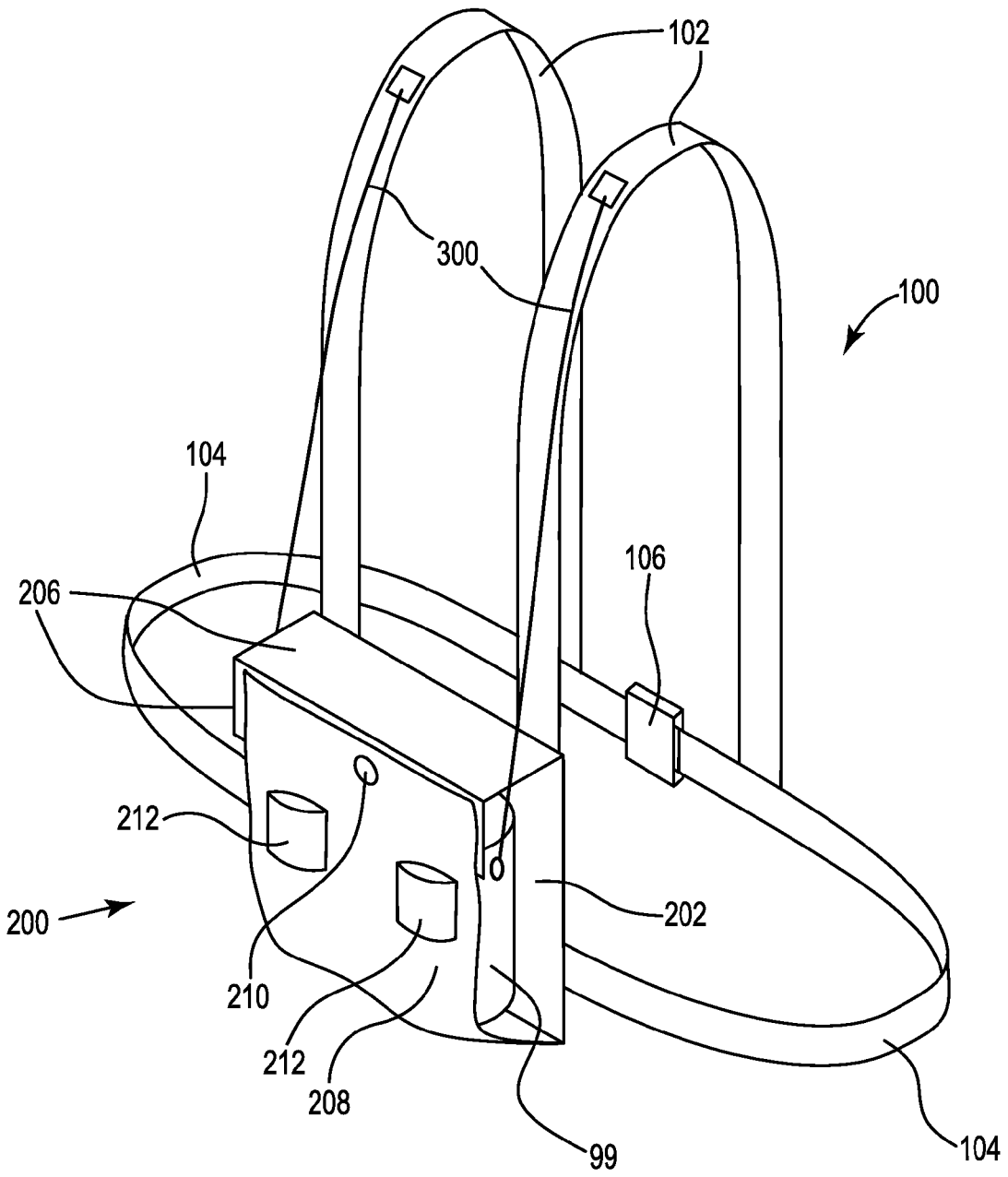
FIG. 3 is a perspective view of the equipment carrier of FIG. 1 with a front panel closed in accordance with an embodiment of the present disclosure.

As best illustrated in FIG. 3, once the equipment 99 is inserted between the panels 202 and 206, the bottom front panel 208 can be pulled forward beneath the equipment 99 and upward in front of the equipment. In that closed arrangement, the panels 202, 206, and 208 enclose the equipment in front, behind, above, and below and hold it in the holder 200. The equipment 99 can be left exposed on the sides, thereby providing the user 50 with access to grasp it while detaching the bottom front panel 208 from the top front panel 206 to release the equipment 99 from the holder 200. The front panel 208 can be multiple substantially rigid segments connected by one or more flexible joints or a single flexible sheet.

Optionally, equipment carrier can include additional pockets or pouches 212, quick-detach sockets, or attachment points to carry other objects (in addition to the equipment 99 in equipment holder 200). Such pockets, pouches, sockets, or attachment points can be located anywhere suitable on the equipment holder 200, such as on back panel 202 or top front panel 206, or on the set 100 of support members 102/104 (or backpack, safety harness, etc.).

Figure 4:
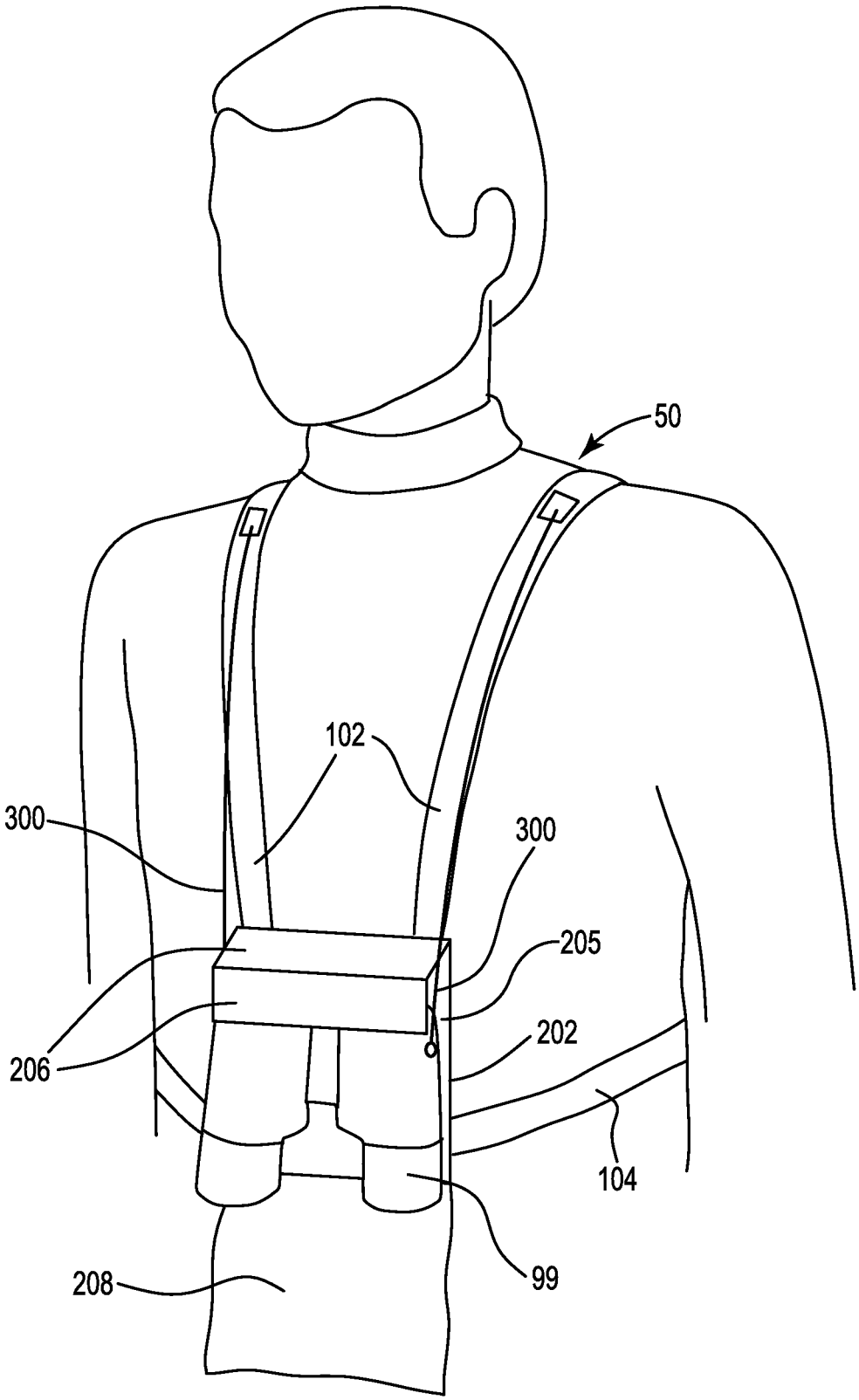
FIG. 4 is a perspective view of the equipment carrier of FIG. 1 securing a device to a user in accordance with an embodiment of the present disclosure.

As best illustrated in FIG. 4, the equipment holder 200 is secured to the user 50 with the equipment 99 retained in the recess 205 by the tension force F with the tethers 300 extended substantially beyond its rest length (as in FIG. 4). The equipment 99 is captured in the recess 205 by the tension force F, even when the bottom front panel 208 is open.

As best illustrated in FIG. 5, the equipment 99 is removed from the equipment holder 200 and available for use by the user 50 with the tethers 300 under negligible tension. In the illustrated embodiment, the equipment 99 can be held by the user's face or head 52 with the tethers 300 under negligible tension (i.e., not extended substantially beyond its rest length). The length of the tethers 300 are optimized so as to not interfere with the user's 50 access to the equipment 99 when removed from the equipment holder 200.

The elongation of and tension on the tethers 300 with the equipment 99 held by the equipment holder 200 can serve to retain the equipment 99 in the holder 200, while permitting the user 50 to access the equipment 99 with one hand. Attaching the tethers 300 at a location offset from the equipment holder 200 provides the tension force F to urges the equipment 99 into the recess 205 as seen in FIG. 4. This arrangement also enables the equipment 99 to be held at or near the wearer's face or head with the tether 300 at its rest length and under negligible tension as in FIG. 5. This configuration permits the user 50 to access the equipment 99 (e.g., by holding binoculars or a camera in front of his eyes) without having to exert force against tension in the tethers 300.

Figure 6A:
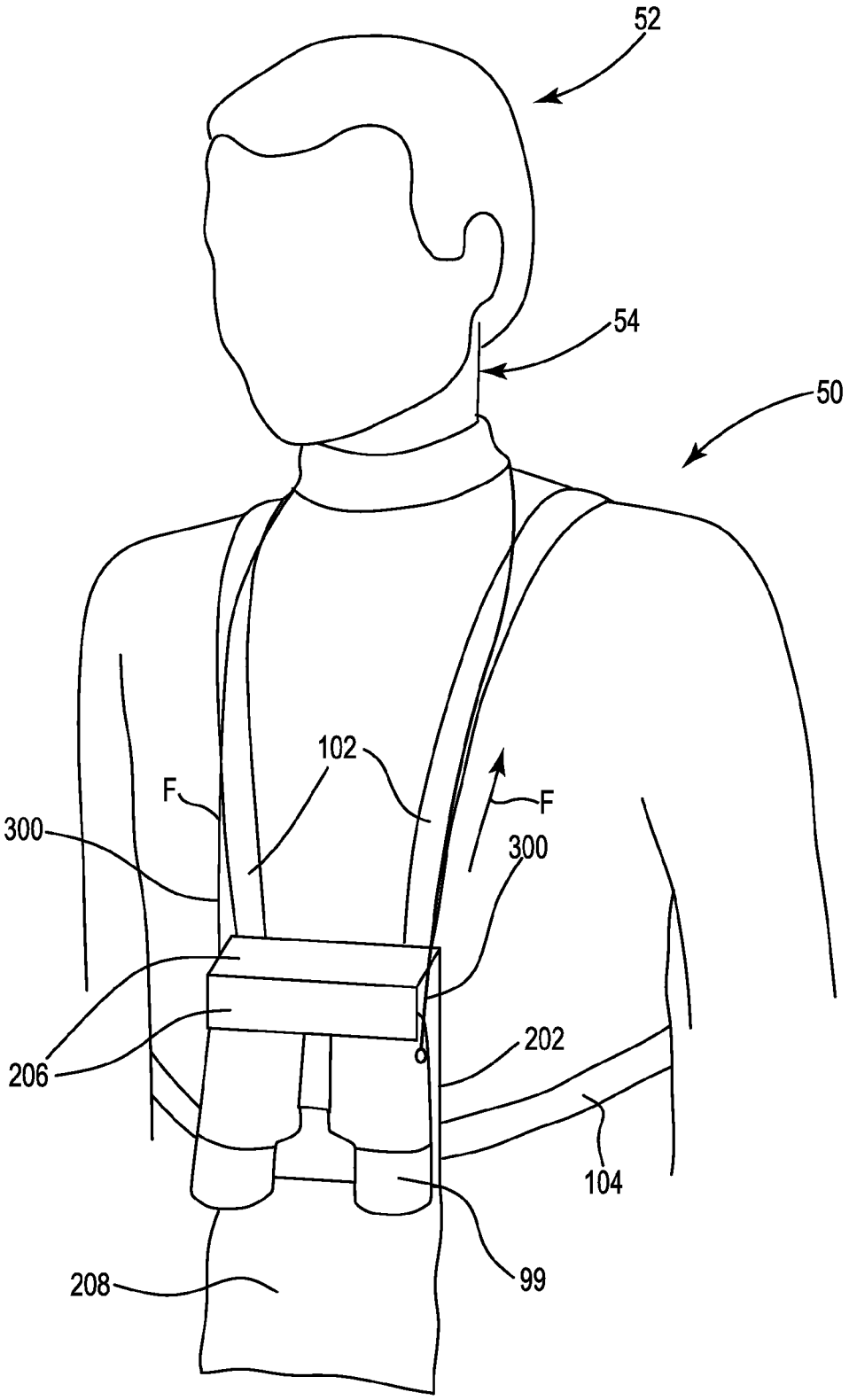
FIG. 6A is a perspective view of an alternate equipment carrier with a tether secured to a user in accordance with an embodiment of the present disclosure.
Figure 6B:
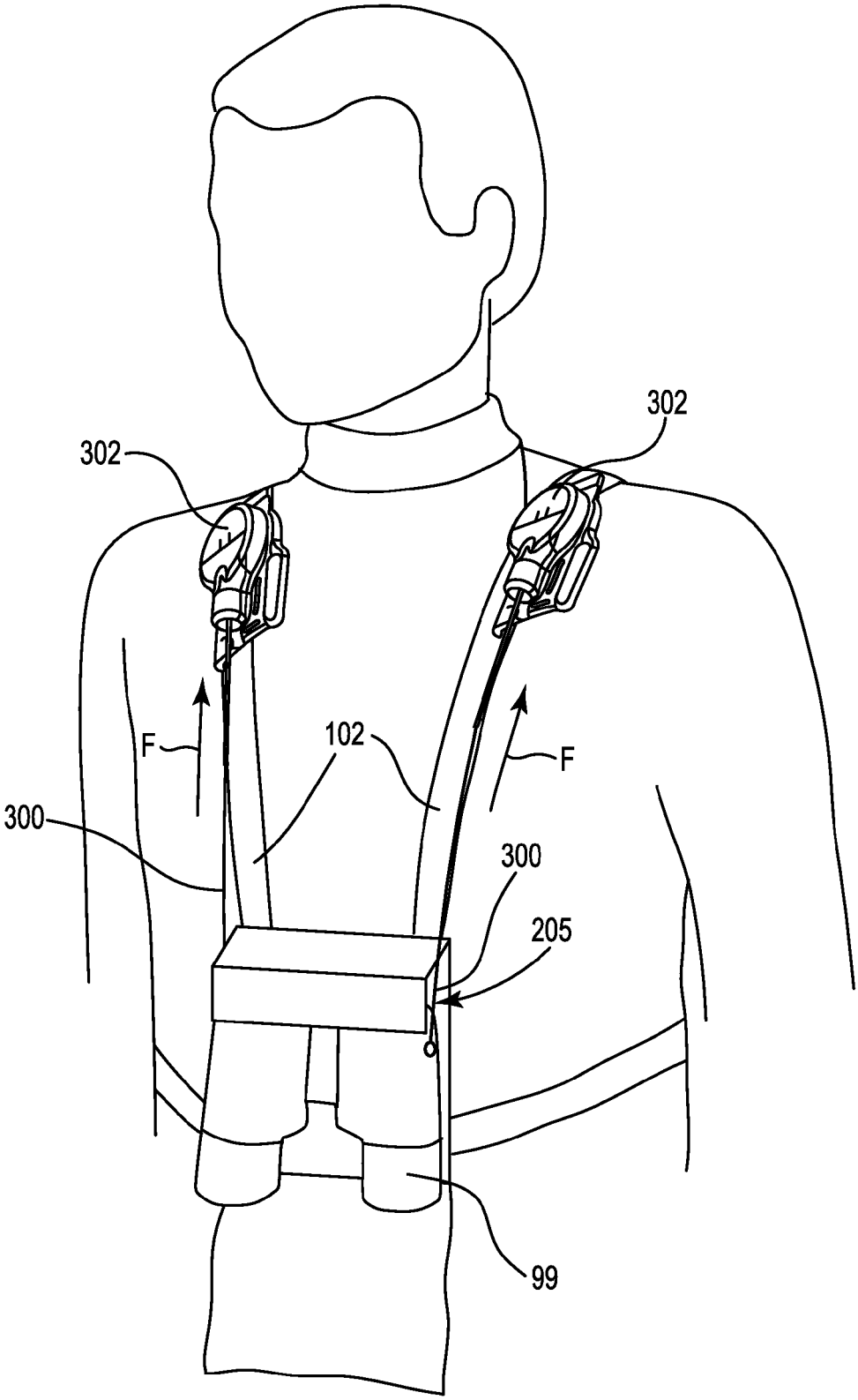
FIG. 6B is a perspective view of an alternate equipment carrier with tethers with retractable mechanisms secured to a user in accordance with an embodiment of the present disclosure.

FIG. 6A illustrates securing the tethers 300 as a discrete component directly to the user 50 in accordance with an embodiment of the present disclosure. The tether 300 merely wraps around the user's neck 54.

As discussed above, tension force F generated by the tether 300 retains the equipment 99 in the recess 205. The tension force F is calibrated so that when the equipment 99 is removed from the equipment holder 200 and raised to the user's head 52 (see e.g., FIG. 5), the tension force F is negligible, and preferably substantially zero.

Wrapping the tether 300 around the user's neck simulates a neck strap, such as for binoculars or a camera, providing easy access. If the user 50 needs to engage in kinetic activity, the equipment 99 is easily engages with the equipment holder 200 using one hand.

FIG. 6B illustrates the use of retraction mechanism 302 to generate tension force F on the tethers 300 that retains the equipment in the recess 205 in accordance with an embodiment of the present disclosure. The retraction mechanism 302 can be a spring-loaded spool or other suitable extension/retraction mechanism. The retraction mechanism 302 can be arranged to enable the tethers 300 to be extended under tension and to be retracted when that tension is sufficiently reduced, and can include a stop that prevents further retraction of the tethers 300 once it is retracted to a desired rest length.

Figure 7:
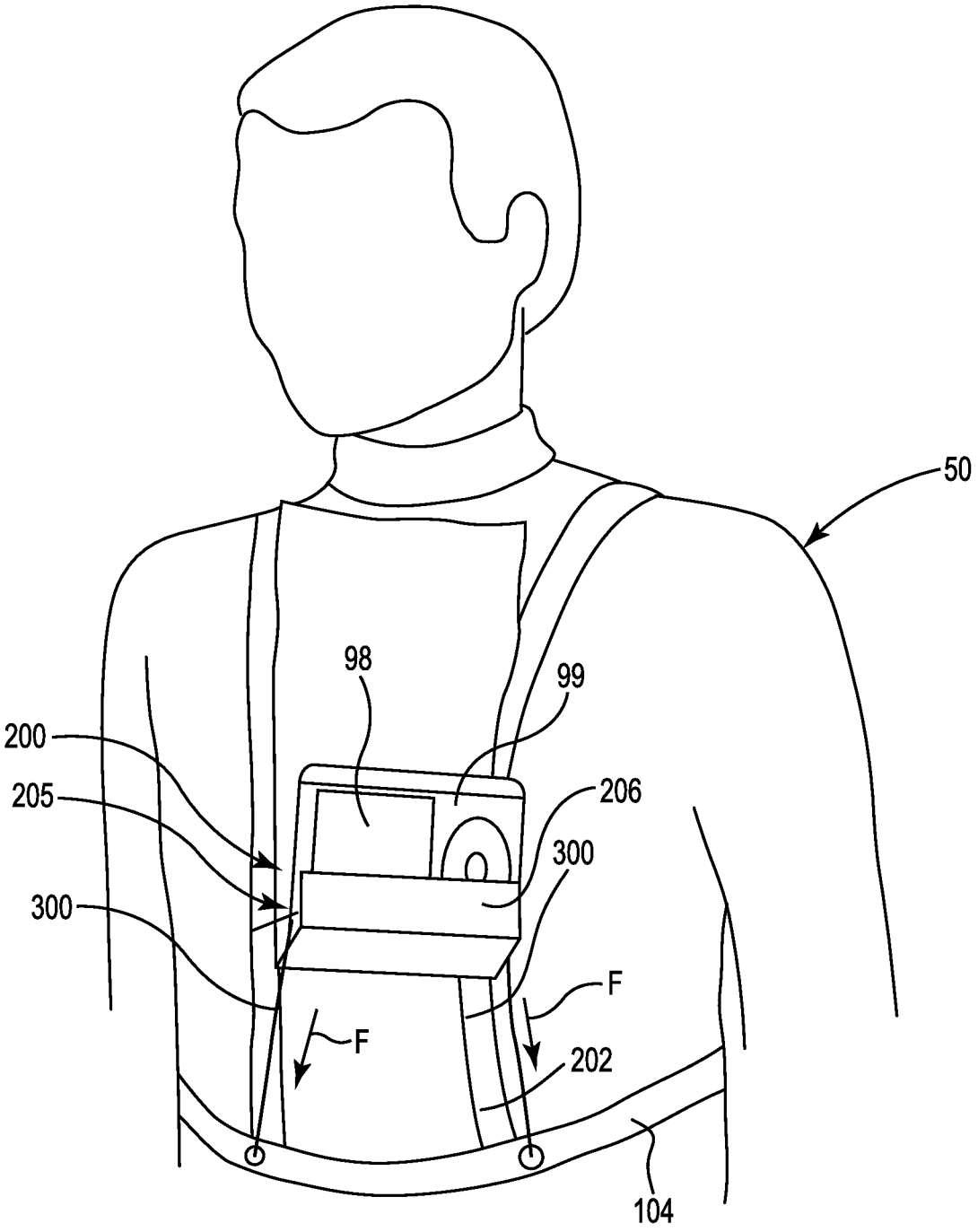
FIG. 7 is a perspective view of an alternate equipment carrier with an inverted equipment holder in accordance with an embodiment of the present disclosure.

FIG. 7 illustrates an embodiment with the tethers 300 attached to the user 50 below the equipment holder 200 in accordance with an embodiment of the present disclosure. The equipment holder 200 includes front panel 206 sized to receive the equipment 99. The tension force F is directed downward toward the waist strap 104 to retain the equipment 99 in the recess 205. In the illustrated embodiment, the equipment 99 is a GPS device with screen 98 that can be viewed at a location below the equipment holder 200.

Figure 8:
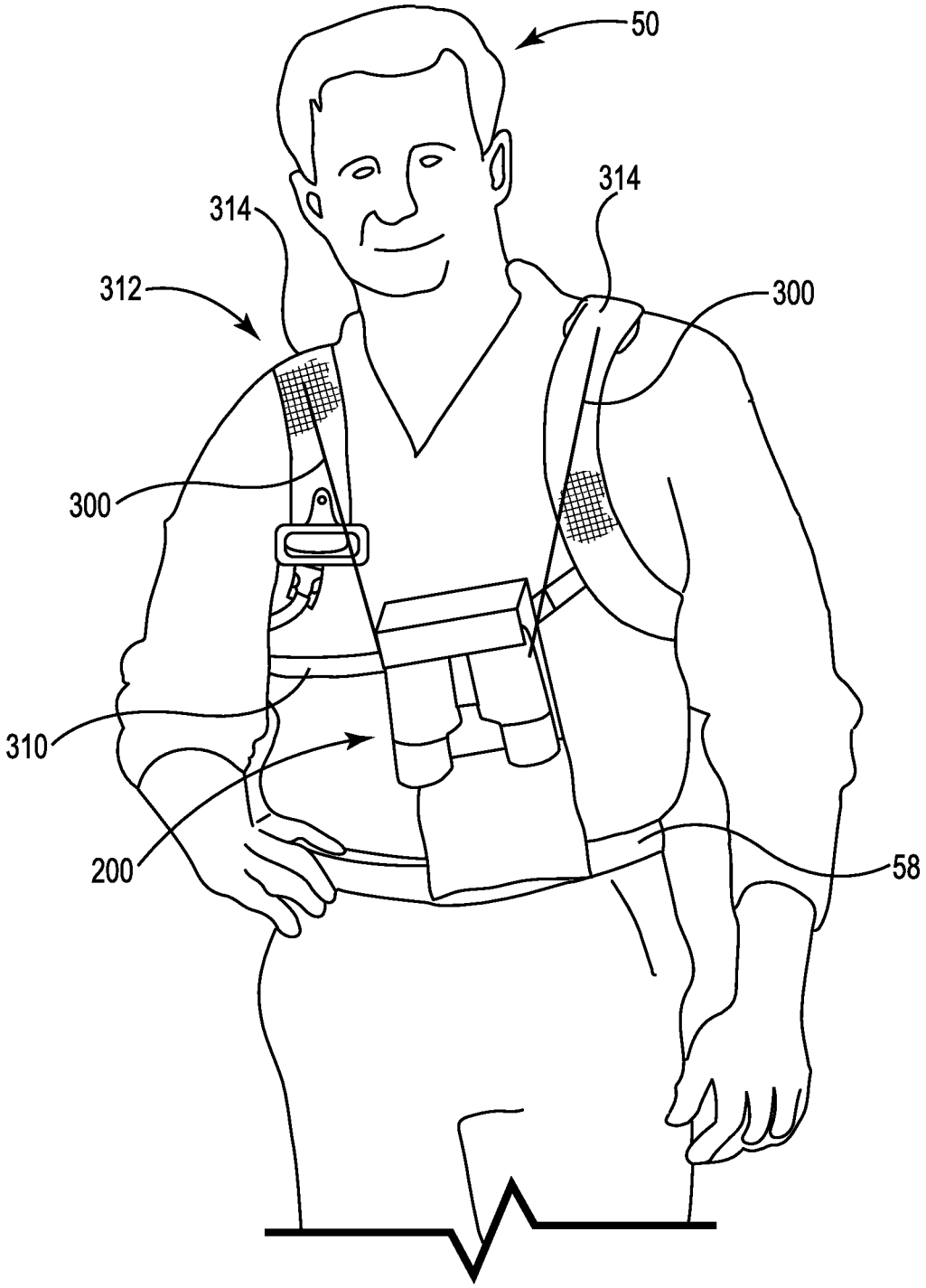
FIG. 8 is a perspective view of an equipment holder and tethers secured to straps of a back pack in accordance with an embodiment of the present disclosure.

FIG. 8 illustrates an alternate equipment holder 200 attached directly to an existing structure, such as chest strap 310 of a backpack 312 in accordance with an embodiment of the present disclosure. The straps 102, 104 are not required. The tethers 300 are attached to shoulder straps 314 of the backpack 312. The equipment holder 200 can be attached to a typical backpack, a safety vest or utility vest, a utility belt, a safety harness, a hydration pack with a bladder, or other garments or equipment that can be worn by a wearer, making the straps 102, 104 unnecessary. In another embodiment, the tethers 300 are attached directly to the user 50, such as the neck strap illustrated in FIG. 6A.

In an alternate embodiment, the equipment holder 200 can be attached to the user's belt 58. The tethers 300 can be attached to the user 50 using any of the techniques disclosed herein, such as by wrapping the tether 300 around the user's neck (see FIG. 6A).

Figure 9:
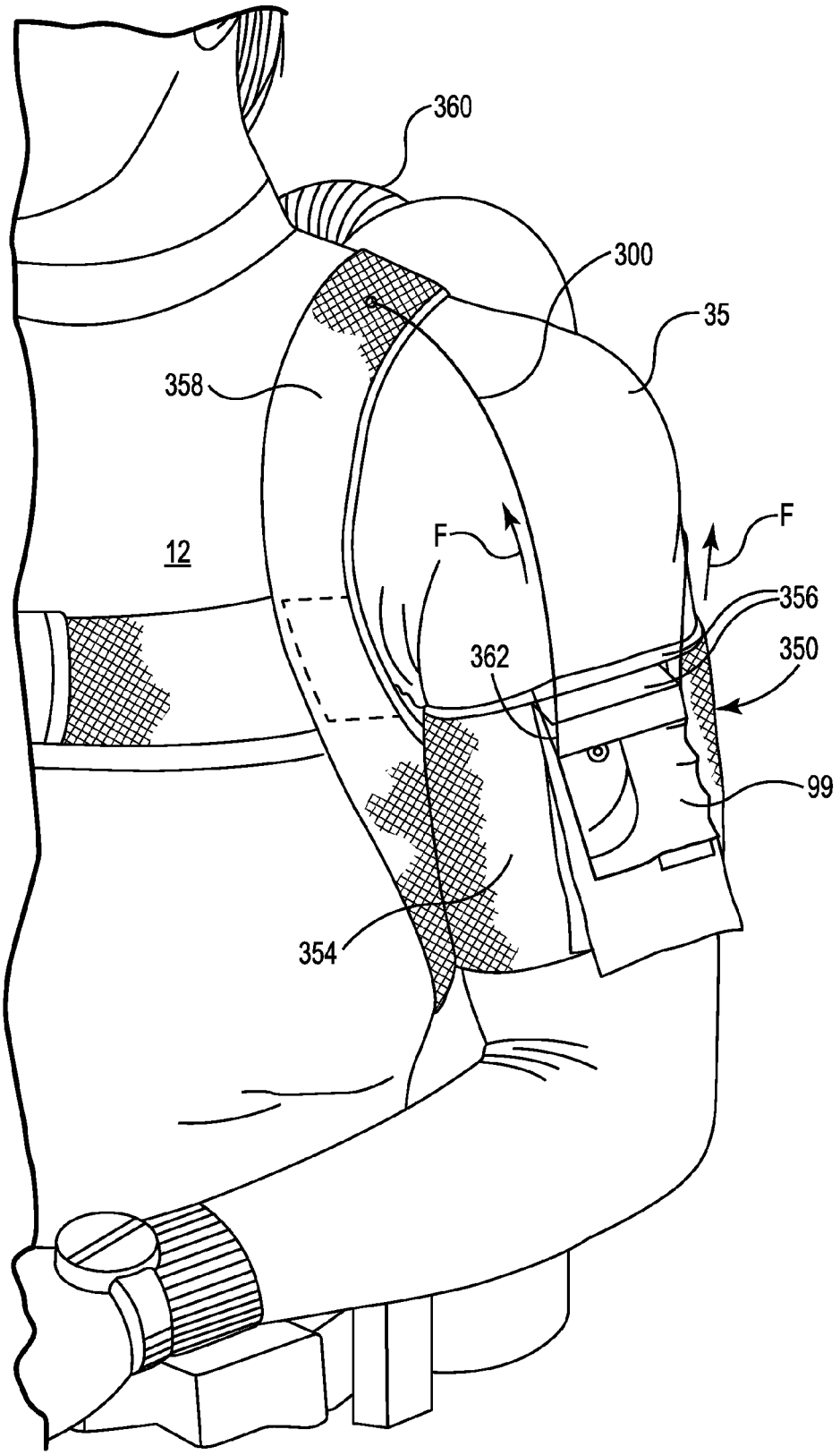
FIG. 9 is a perspective view of an equipment carrier secured to a user's arm in accordance with an embodiment of the present disclosure.

FIG. 9 illustrates an alternate equipment carrier 350 attached to a user's limb 352 in accordance with an embodiment of the present disclosure. Elastic strap 354 secures equipment holder 356 to the user's arm 352. In the illustrated embodiment, the tethers 300 are secured to shoulder straps 358 on backpack 360. As discussed above, tension force F generated by the tethers 300 biases the equipment 99 into recess 362. In the illustrated embodiment, the equipment 99 is a rangefinder.

In use, the user 50 removes the rangefinder 99 from the equipment holder 356 and raises it to his eye. The length of the tethers 300 permit the user 50 to raise the rangefinder 99 to his eye with little or no resistance.

Figure 10:
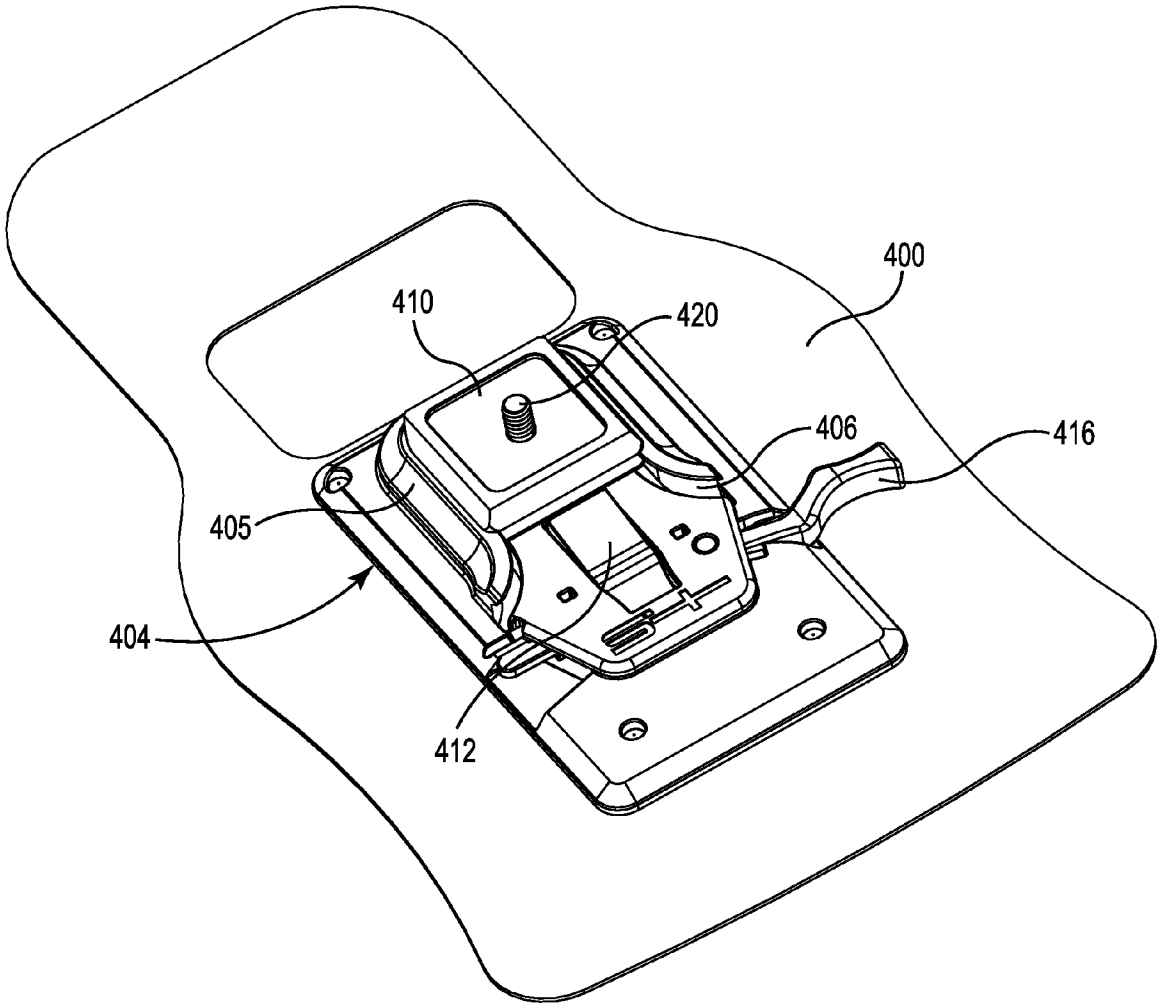
FIG. 10 illustrates an alternate back panel with a removable base plate for an equipment holder in accordance with an embodiment of the present disclosure.
Figure 11:
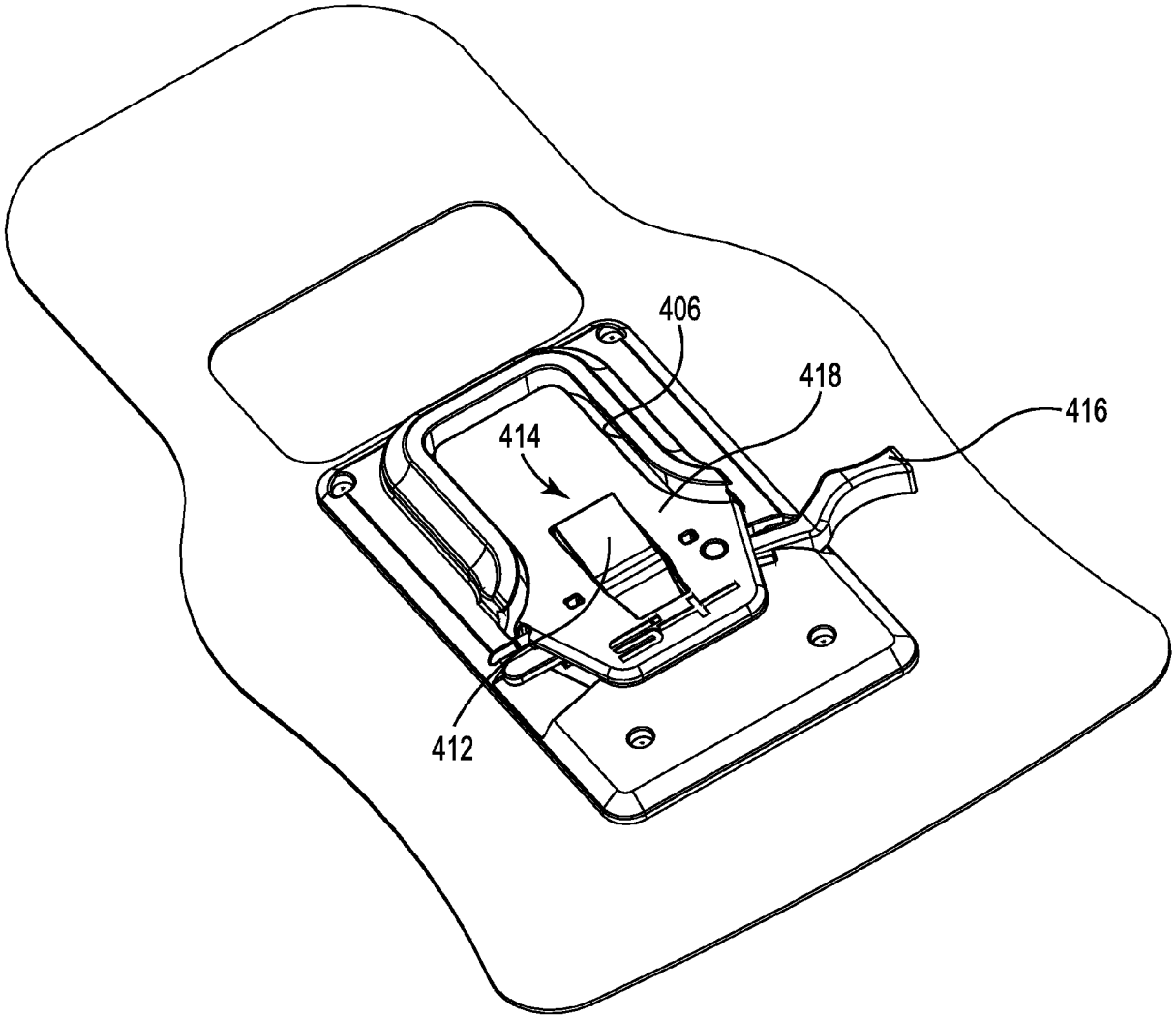
FIG. 11 is a perspective view of the back panel of FIG. 10 without the removable base plate in accordance with an embodiment of the present disclosure.
Figure 12:
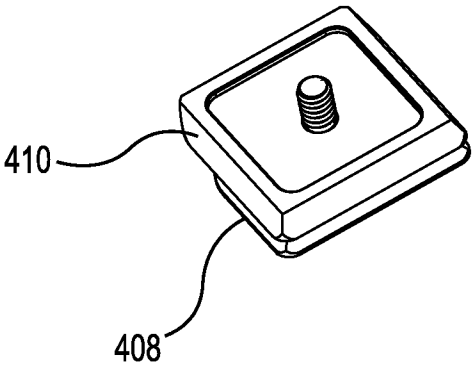
FIG. 12 is a perspective view of the removable base plate of FIG. 10.

FIGS. 10-12 illustrate an alternate back panel 400 for an equipment holder 402 in accordance with an embodiment of the present disclosure. Locking assembly 404 includes housing 405 with channels 406 configured to engage with recesses 408 on removable base plate 410. Locking flap 412 is biased to locked configuration 414 that retains the removable base plate 410 in the channels 406. As will be discussed in detail below, trigger 416 lowers the locking flap 412 to be flush with surface 418 so the removable base plate 410 can be slide out of the channels 406.

In the illustrated embodiment, the removable base plate 410 includes threaded member 420 that attaches to the equipment 99, such as for example a camera. In one embodiment, the removable base plate 410 is configured to attach to a tripod or other structure.

Figure 13:
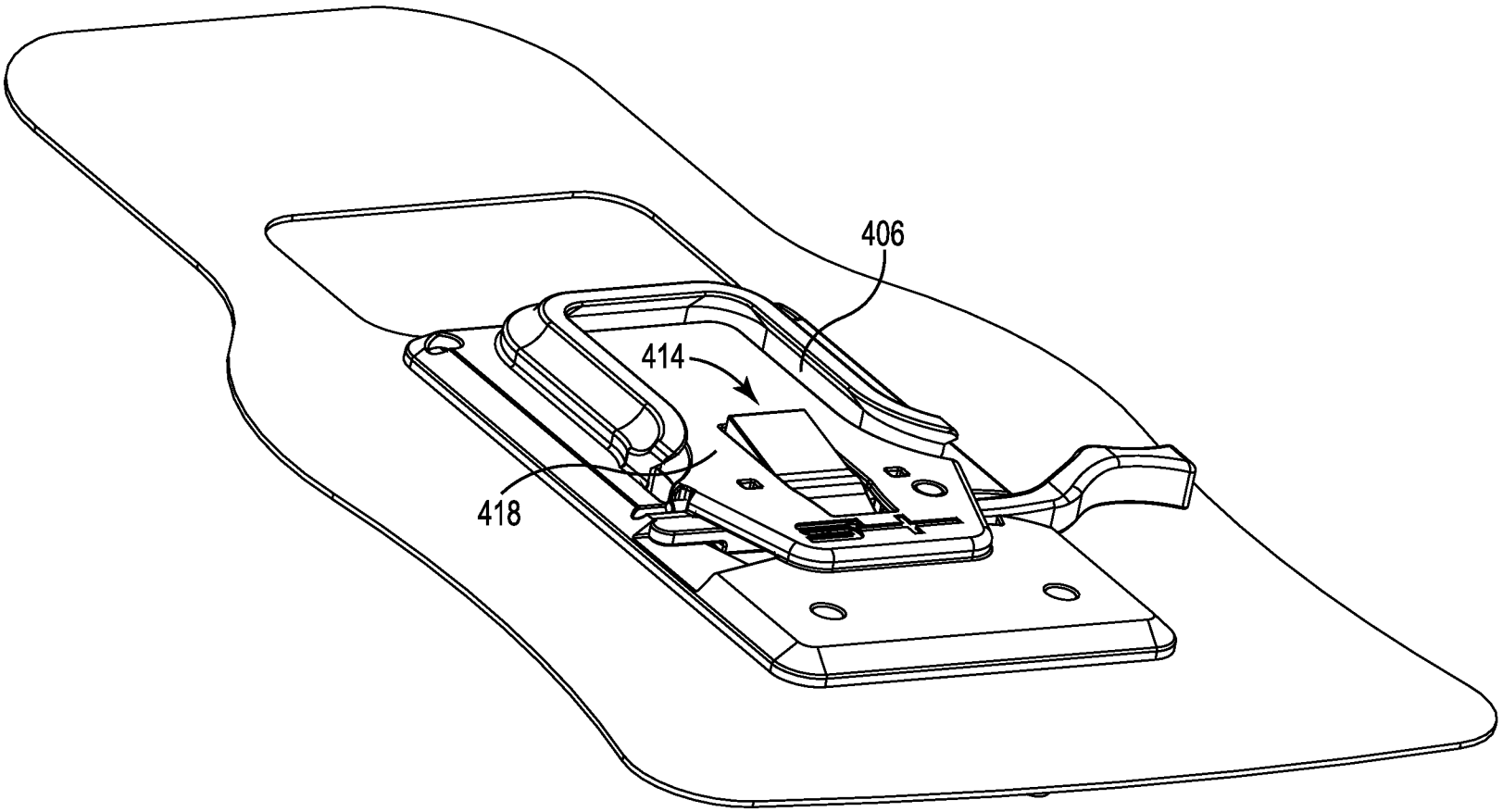
FIG. 13 is a perspective view of a locking assembly on the back panel of FIG. 10 in a locked configuration in accordance with an embodiment of the present disclosure.
Figure 14:
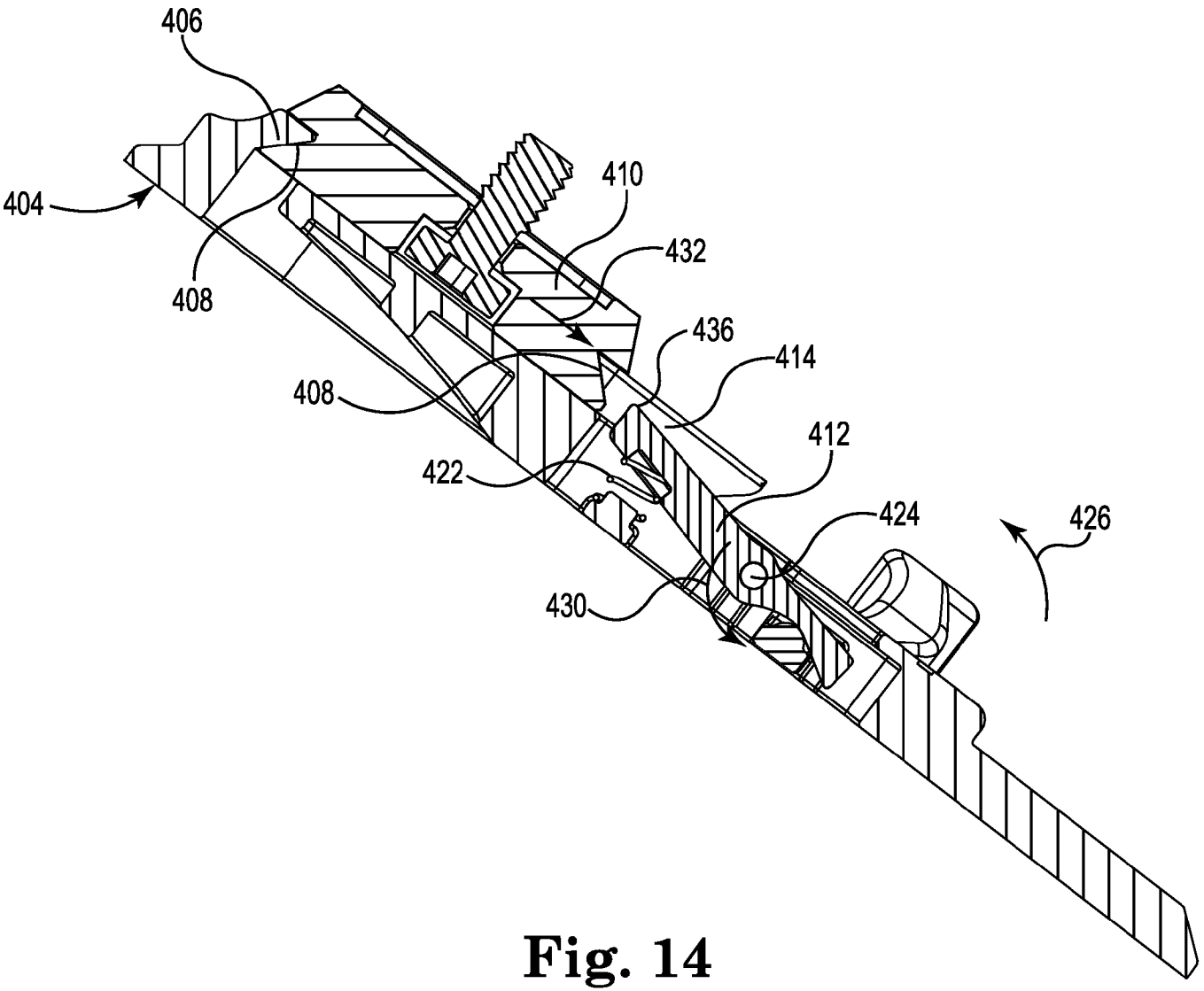
FIG. 14 is a sectional view of a locking assembly on the back panel of FIG. 10 in a locked configuration in accordance with an embodiment of the present disclosure.

FIGS. 13 and 14 illustrate operation of the lock 404. FIG. 14 shows the locking assembly 404 with housing 405 removed for clarity. FIG. 13 shows spring 422 biasing the locking flap 412 in the locked configuration 414. The locking flap 412 is attached to the locking assembly 404 by pivot pin 424.

Figure 15:
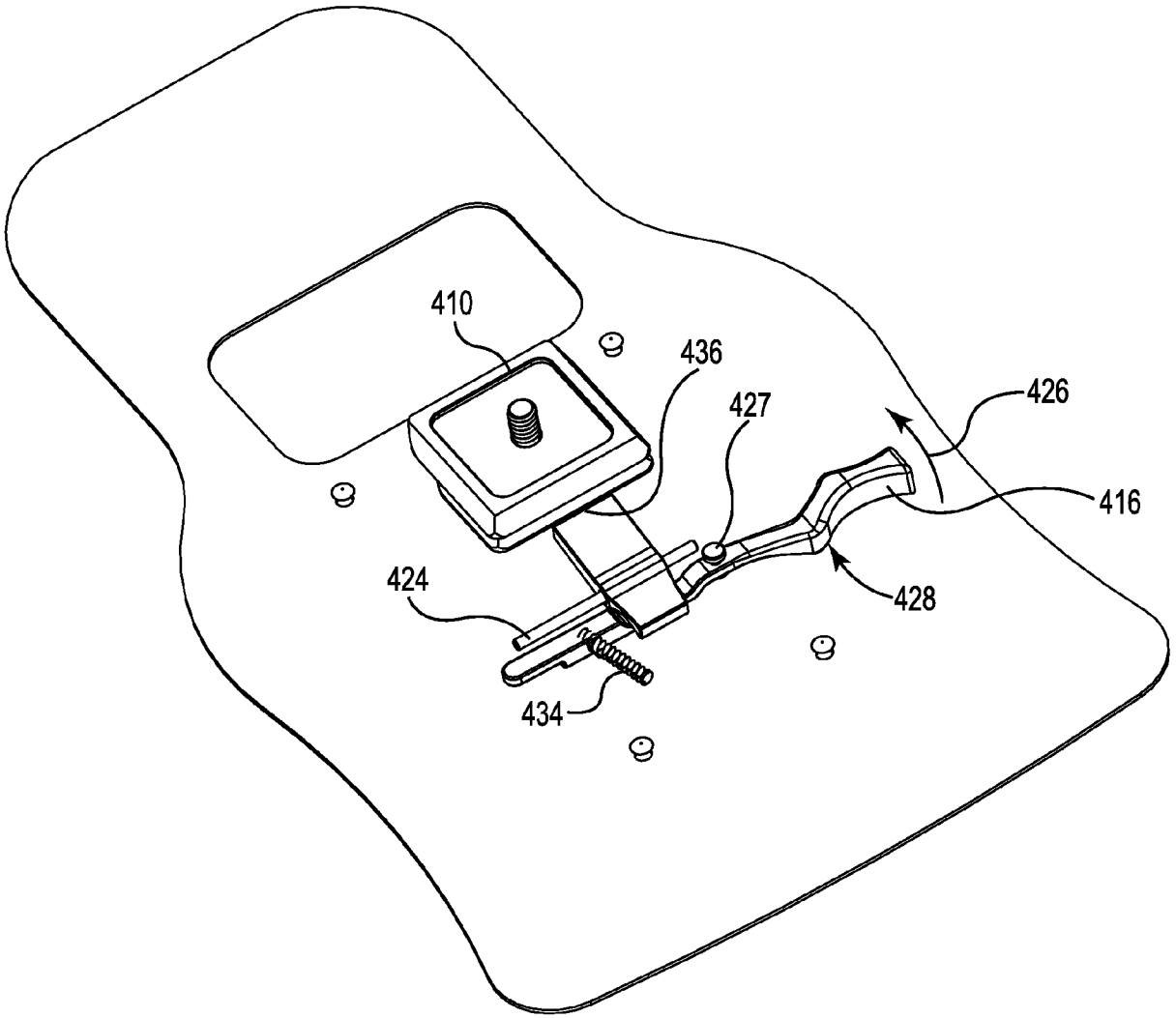
FIG. 15 illustrates operation of the locking assembly of FIG. 10 in accordance with an embodiment of the present disclosure.

In operation, best illustrated in FIG. 15, moving the trigger 416 in direction 426 around pivot point 427 from locked configuration 428 to an unlocked configuration causes the locking flap 412 to rotate in direction 430 so the removable base plate 410 can be slide in direction 432 and out of the channels 406. Spring 434 biases the trigger 416 back to the locked configuration 428 so the locking flap 412 can return to the locked configuration 414.

The removable base plate 410 can be returned to the locking assembly 404 simply by sliding it along the surface 418 and into the channels 406. The biasing force of the spring 422 is overcome until the removable base plate 410 is past leading edge 436, after which the spring 422 returns the locking flap 412 to the locked configuration 414.

Where a range of values is provided, it is understood that each intervening value, to the tenth of the unit of the lower limit unless the context clearly dictates otherwise, between the upper and lower limit of that range and any other stated or intervening value in that stated range is encompassed within this disclosure. The upper and lower limits of these smaller ranges which may independently be included in the smaller ranges is also encompassed within the disclosure, subject to any specifically excluded limit in the stated range. Where the stated range includes one or both of the limits, ranges excluding either both of those included limits are also included in the disclosure.

Unless defined otherwise, all technical and scientific terms used herein have the same meaning as commonly understood by one of ordinary skill in the art to which this disclosure belongs. Although any methods and materials similar or equivalent to those described herein can also be used in the practice or testing of the various methods and materials are now described. All patents and publications mentioned herein, including those cited in the Background of the application, are hereby incorporated by reference to disclose and described the methods and/or materials in connection with which the publications are cited.

The publications discussed herein are provided solely for their disclosure prior to the filing date of the present application. Nothing herein is to be construed as an admission that the present disclosure is not entitled to antedate such publication by virtue of prior invention. Further, the dates of publication provided may be different from the actual publication dates which may need to be independently confirmed.

Other embodiments are possible. Although the description above contains much specificity, these should not be construed as limiting the scope of the disclosure, but as merely providing illustrations of some of the presently preferred embodiments. It is also contemplated that various combinations or sub-combinations of the specific features and aspects of the embodiments may be made and still fall within the scope of this disclosure. It should be understood that various features and aspects of the disclosed embodiments can be combined with or substituted for one another in order to form varying modes disclosed. Thus, it is intended that the scope of at least some of the present disclosure should not be limited by the particular disclosed embodiments described above.

Thus the scope of this disclosure should be determined by the appended claims and their legal equivalents. Therefore, it will be appreciated that the scope of the present disclosure fully encompasses other embodiments which may become obvious to those skilled in the art, and that the scope of the present disclosure is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present disclosure, for it to be encompassed by the present claims. Furthermore, no element, component, or method step in the present disclosure is intended to be dedicated to the public regardless of whether the element, component, or method step is explicitly recited in the claims.

What is claimed is:

1. An equipment carrier comprising:

i) a backpack comprising a first shoulder strap, a second shoulder strap, and a chest strap;

ii) a first tether, wherein a first end of the first tether is attached to the first shoulder strap, and a second end of the first tether is attached to an equipment item;

iii) a second tether, wherein a first end of the second tether is attached to the second shoulder strap, and a second end of the second tether is attached to the equipment item;

iv) an equipment holder attached to the chest strap, the equipment holder comprising:

a) a back panel;

b) a top panel attached to the back panel;

c) a front panel attached to the top panel, wherein the back panel, top panel, and front panel form a substantially rigid bracket having a small degree of elastic formability so as to form a recess sized to receive the equipment item and to provide an interference fit when the equipment item is inserted into the recess; and d) a flexible bottom front panel attached to the back panel, wherein the bottom front panel is attached to the top front panel by a fastener; and v) one or more pockets, pouches, quick-detach sockets, or attachment points to carry other objects, wherein the one or more pockets, pouches, quick-detach sockets, or attachment portions are attached to the equipment holder, the first shoulder strap, the second shoulder strap, or the chest strap;

wherein the first and second tethers can be lengthened beyond a rest length of the first and second tethers when the first and second tethers are under tension, and the tension in the first and second tethers is sufficient to retain the equipment item within the recess in the substantially rigid bracket of the equipment holder, and wherein the first and second tethers are not extended substantially beyond the rest length of the first and second tethers and are under negligible tension when the equipment item is not retained within the equipment holder and is positioned near the face or head of a wearer of the equipment carrier.

2. The equipment carrier of claim 1 comprising a retraction mechanism configured to generate the tension force.

3. The equipment carrier of claim 1, wherein each of the first tether and the second tether comprise an elastic material.

4. The equipment carrier of claim 1, wherein each of the first tether and the second tether provide a bias force when extended.

5. The equipment carrier of claim 1, wherein the top panel and the front panel comprise a ductile metal.

6. The equipment carrier of claim 1, wherein the top panel and the front panel comprise a thermoplastic material.

7. The equipment carrier of claim 1, wherein the fastener comprises a snap.

8. The equipment carrier of claim 1, wherein the fastener comprises a magnet.

9. The equipment carrier of claim 1, wherein the equipment item comprises binoculars.

10. The equipment carrier of claim 1, wherein the equipment item comprises a laser rangefinder.

* * * * *